US008696062B2

(12) United States Patent
Brown

(10) Patent No.: US 8,696,062 B2
(45) Date of Patent: Apr. 15, 2014

(54) MULTIPLE-CHAIR COVER

(76) Inventor: Kent L. Brown, Des Moines, IA (US)

( * ) Notice: Subject to any disclaimer, the term of this patent is extended or adjusted under 35 U.S.C. 154(b) by 572 days.

(21) Appl. No.: 12/878,335

(22) Filed: Sep. 9, 2010

(65) Prior Publication Data

US 2011/0074192 A1 Mar. 31, 2011

Related U.S. Application Data

(60) Provisional application No. 61/246,736, filed on Sep. 29, 2009, provisional application No. 61/262,936, filed on Nov. 20, 2009, provisional application No. 61/325,446, filed on Apr. 19, 2010.

(51) Int. Cl.
*A47C 31/00* (2006.01)

(52) U.S. Cl.
USPC ..... 297/219.1; 297/223; 297/224; 297/225; 297/228.1; 297/232; 297/244; 297/248; 108/90; 150/158

(58) Field of Classification Search
USPC ..... 297/219.1, 223–226, 228.1, 228.11, 297/228.12, 228.13, 232, 244, 248, 249, 297/229, 257; 108/90; 150/158
See application file for complete search history.

(56) References Cited

U.S. PATENT DOCUMENTS

| | | | | |
|---|---|---|---|---|
| 2,227,180 | A * | 12/1940 | Falk | 297/223 |
| 2,688,998 | A * | 9/1954 | Erickson et al. | 297/219.1 |
| 2,793,683 | A * | 5/1957 | Trubitt | 297/224 |
| 4,718,721 | A * | 1/1988 | Pompa | 297/228.11 |
| 5,582,115 | A * | 12/1996 | Muller | 108/90 |
| 5,584,422 | A * | 12/1996 | Bond-Madsen | 224/155 |
| 5,694,866 | A * | 12/1997 | Muller | 108/161 |
| 6,044,774 | A * | 4/2000 | Gelbart | 108/90 |
| 6,142,565 | A * | 11/2000 | Rieder | 297/219.12 |
| 6,206,468 | B1 * | 3/2001 | Brosnan et al. | 297/228.1 |
| 6,726,277 | B1 * | 4/2004 | Samaha | 297/184.11 |
| 6,948,771 | B1 * | 9/2005 | Salandy | 297/228.11 |
| 7,448,681 | B1 * | 11/2008 | Spitzer | 297/228.13 |
| 7,472,953 | B1 * | 1/2009 | Lalji | 297/224 |
| 7,665,804 | B1 * | 2/2010 | Jeffrey | 297/220 |
| D611,751 | S * | 3/2010 | Siklosi | D6/611 |
| 8,104,840 | B2 * | 1/2012 | Tarumi et al. | 297/452.48 |
| 8,256,839 | B2 * | 9/2012 | Schropfer | 297/219.12 |

* cited by examiner

*Primary Examiner* — Laurie Cranmer
(74) *Attorney, Agent, or Firm* — Zarley Law Firm, P.L.C.

(57) ABSTRACT

A multiple-chair cover having a front side, a back side a right edge and a left edge with an open interior area positioned therebetween. At least one divider is positioned within the open interior which separates the open interior into separate compartments. At least one pad is positioned within the open interior. This provides a multiple-chair cover which prevents chairs from rattling against one another while in transit while also maintaining the alignment and position of multiple chairs.

18 Claims, 7 Drawing Sheets

MULTIPLE-CHAIR COVER

CROSS REFERENCE TO RELATED APPLICATIONS

This application claims the benefit of U.S. Provisional Application No. 61/246,736 filed Sep. 29, 2009, and U.S. Provisional Application 61/262,936 filed Nov. 20, 2009, and U.S. Provisional Application 61/325,446 filed Apr. 19, 2010.

BACKGROUND OF THE INVENTION

This invention relates to a cover. More specifically, this invention relates to a cover for multiple chairs.

Chair covers are well known in the art and generally comprise a layer of material to cover the chair to protect the chair from the environment or to improve the chair's appearance. Still, a need exists in the art for a multiple chair cover that prevents multiple chairs from rattling against one another when in transit such as in a Recreational Vehicle or camper. Another need exists in the art for a multiple chair cover that maintains the position of multiple chairs in relation to one another. Therefore an object of the present invention is to provide a multiple chair cover that prevents chairs from rattling against one another when in transit. Therefore another object of the present invention is to provide a multiple chair cover that maintains the position of multiple chairs in relation to one another.

This and other objects, features, or advantages will become apparent from the specification.

BRIEF SUMMARY OF THE INVENTION

A multiple-chair cover having a front side, a back side a right edge and a left edge with an open interior area positioned therebetween. At least one divider is positioned within the open interior which separates the open interior into separate compartments. At least one pad is positioned within the open interior. This provides a multiple-chair cover which prevents chairs from rattling against one another while in transit while also maintaining the alignment and position of multiple chairs.

BRIEF DESCRIPTION OF THE DRAWINGS

FIG. 2 A is a bottom plan view of a first embodiment of a multiple-chair cover having three pockets.

DETAILED DESCRIPTION OF THE INVENTION

Figure 1:
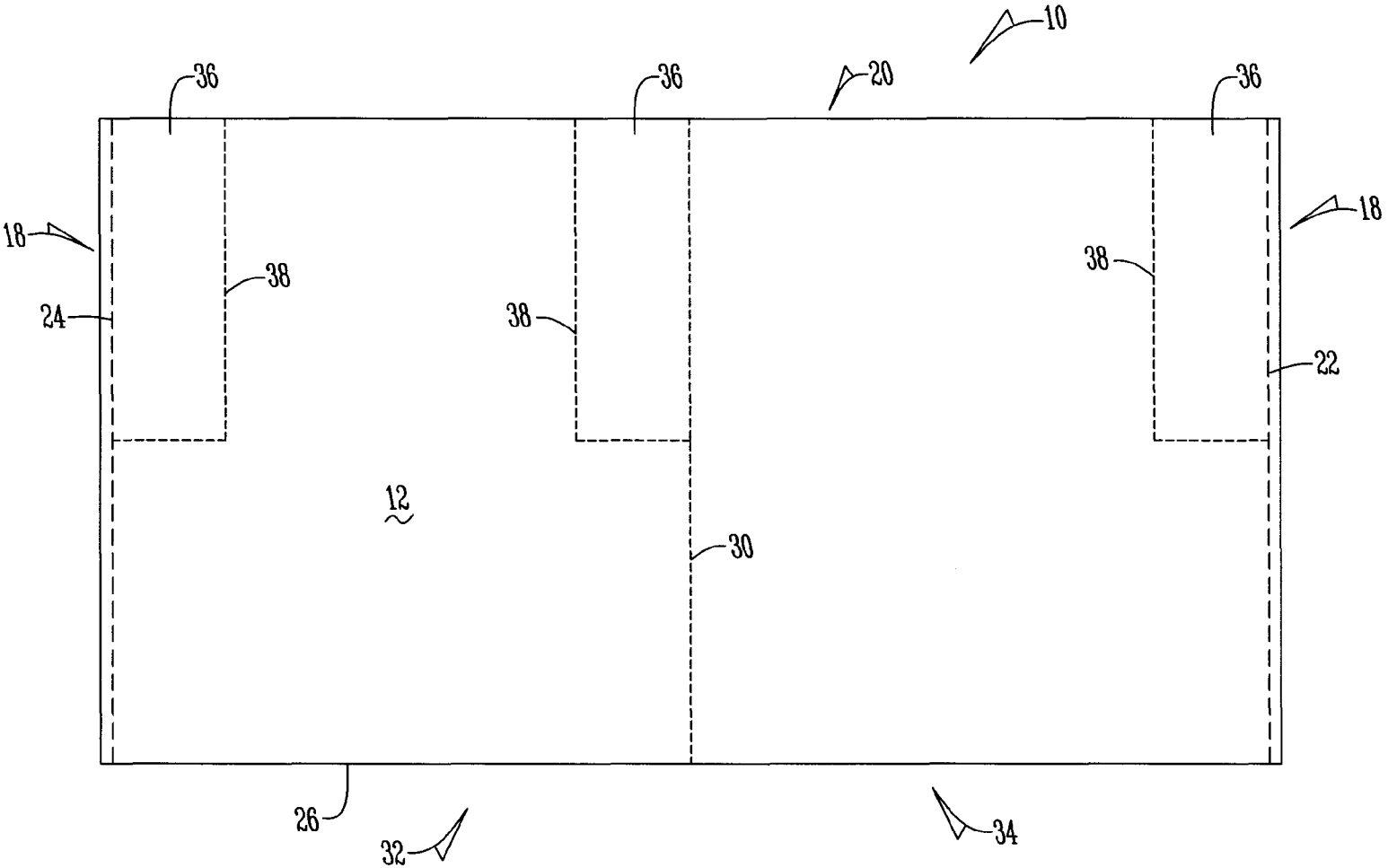
FIG. 1 is a side plan view of a first embodiment of a multiple-chair cover.
Figure 1A:
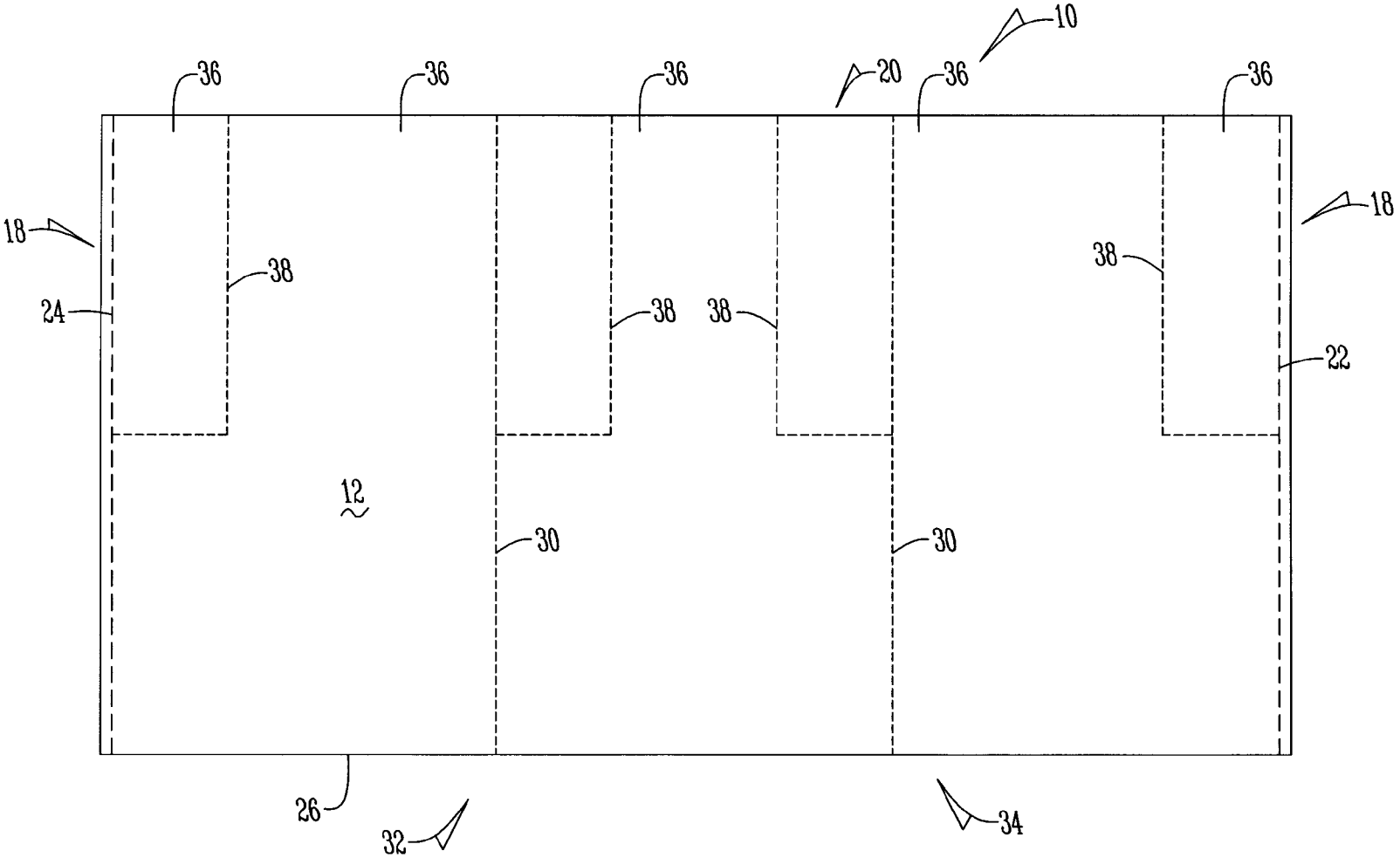
FIG. 1A is a side plan view of a first embodiment of a multiple-chair cover having three pockets.
Figure 2:
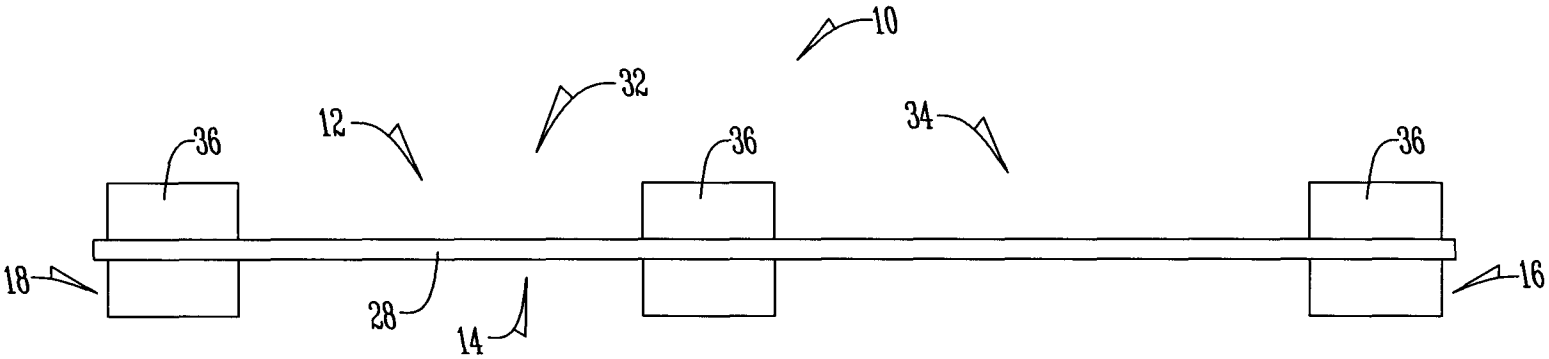
FIG. 2 is a bottom plan view of a first embodiment of a multiple-chair cover.
Figure 2A:
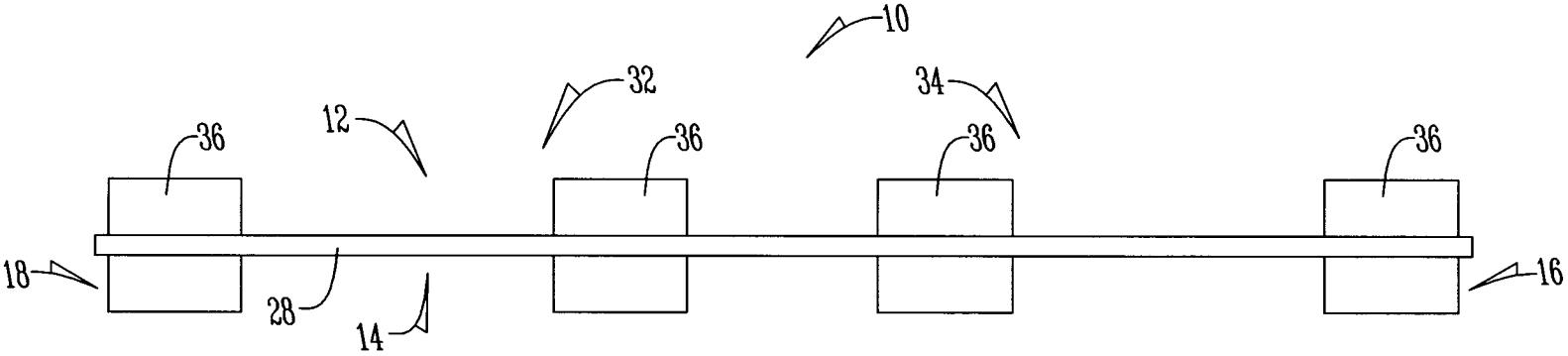

Referring to FIGS. 1 and 2 a multiple-chair cover 10 has a front side 12, a back side 14 a right edge 16 and a left edge 18. The multiple-chair cover 10 preferably is made of a single piece of material, such as cloth, canvas, synthetic material, plastic or the like, which is folded over upon itself at a top edge 20 that separates the front side 12 from the back side 14. Alternatively, a separate piece of material can be used for the front side 12 and the back side 14 which are joined at top edge 20 by any means known in the art such as stitching, gluing, welding or the like. The front side 12 and back side 14 are joined to one another at a right seam 22 and at a left seam 24. The multiple-chair cover terminates at a bottom edge 26. At the bottom edge 26 the front side 12 and back side 14 are not connected to one another.

The cover 10 has an open interior 28 with at least one center divider 30 positioned between right edge 16 and left edge 18 to separate the interior 28 into first compartment 32 and second compartment 34. In a preferred embodiment, center divider 30 extends from top edge 20 to the bottom edge 26 connecting the front side 12 and the back side 14. Although only two compartments 32, 34 are depicted in the figures, additional compartments are contemplated by the addition of more center dividers 30 and an additional length of cover material 10. Dividers are any means known in the art such as stitching, gluing, welding or the like that provide a separation or divide a space.

Also preferably located between front side 12 and back side 14 is at least one pad 36. In a preferred embodiment pad 36 is made of soft malleable foam material. Alternatively, pad 36 is made of any material known in the art that absorbs shock and/or is malleable such as rubber, plastic, Styrofoam, cotton, cloth, air bags, or the like. Pad 36 is held in place by pad seam 38 which connects the front side 12 to the back side 14 around pad 36 or is otherwise the same configuration as divider 30. In a preferred embodiment, a pad 36 is positioned between first compartment 32 and second compartment 34 adjacent center divider 30. As can be seen from FIG. 2, the pad 36 bulges outwardly from the multiple-chair cover 10 so as to engage the surrounding environment and help prevent rattling. In a preferred embodiment, pad 36 extends vertically from top edge 20 partially down open interior 28 and terminates before bottom edge 26. Alternatively, pad 36 extends the entire vertical length of open interior 28 between top edge 20 and bottom edge 26. In an alternative embodiment, pad 36 extends horizontally across the length of cover 10 within open interior 28 adjacent top edge 20.

In operation, when for example, riding in a recreational vehicle that has several chairs that rattle, a user slides the interior 28 of the first compartment 32 over the back of a first chair until the top of the back of the first chair engages the top edge 20 of the multiple chair cover 10. In this position the back of the first chair is fully received in the first compartment 32. When in place, pad 36 is forced to partially deform around the back of the first chair and exert a frictional force against the back of the first chair and keep the multiple chair cover 36 taut over the back of the chair. Similarly, the second compartment 34 is placed over the back of a second chair.

By placing the multiple-chair cover 10 over the backs of several chairs adjacent to one another, the multiple chair cover acts to prevent the chairs from rattling against one another and from rattling against the adjacent walls of the RV when in transit. When the chairs vibrate, the malleable pad 36 acts as a shock absorber between multiple chairs, and/or between a chair and the surrounding environment. Also, the multiple-chair cover acts to hold the chairs in place and prevents the chairs from moving around the cabin.

Figure 3:
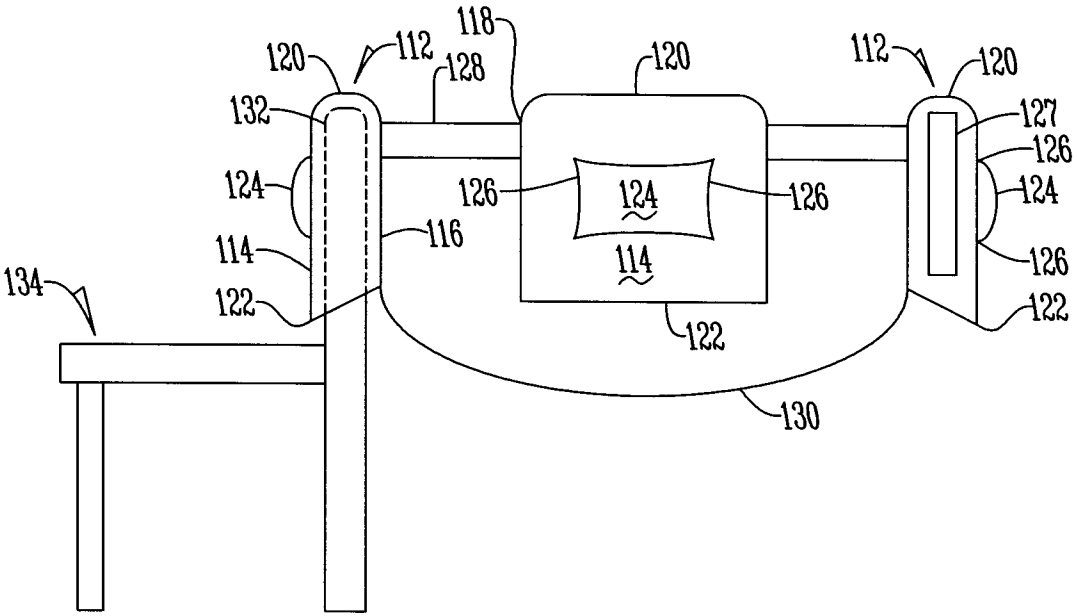
FIG. 3 is a side plan view of a second embodiment of a multiple-chair cover.
Figure 4:
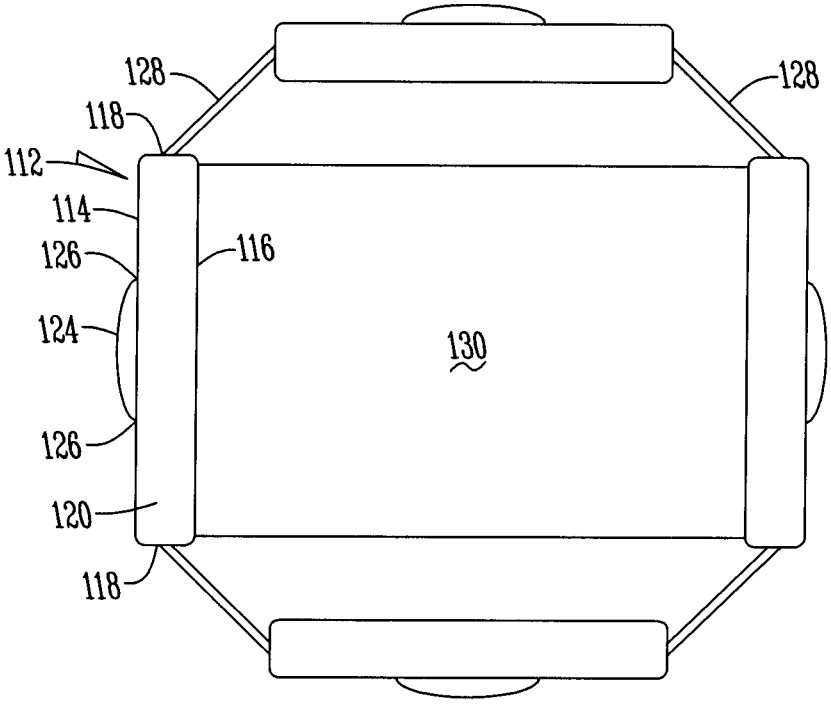
FIG. 4 is a top plan view of a second embodiment of a multiple-chair cover.
Figure 5:
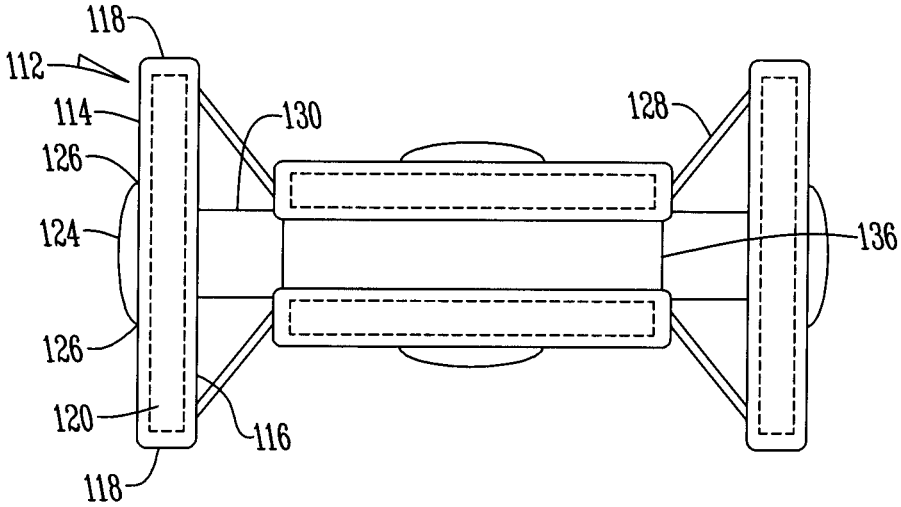
FIG. 5 is a top plan view of a different arrangement of a second embodiment of a multiple-chair cover.

Referring to FIGS. 3, 4 and 5 a multiple-chair cover 110 has a plurality of pockets 112, each pocket 112 has a front 114, a back 116, a pair of sides 118, a closed top 120, and bottom edge 122. The pockets are preferably made of a single layer of material, such as cloth, canvas, synthetic material, plastic or the like which is folded over upon itself at top edge 120, which separates the front side 114 from the back side 116. Alternatively, a separate piece of material is used for the front side 114 and back side 116 which are joined at a seam located at or near the top 120 by any means known in the art such as stitching, gluing, welding or the like. Similarly, front side 114 and back side 116 are also connected to one another at a seam located at each side 118. The front side 114 and back side 116 remain unconnected to one another at the bottom edge 122 providing an open bottom 122.

Connected either to the front 114, back 116, top 120 or sides 118 of each pocket 112 is an elastic strap 124. Elastic strap 124 is connected at its ends 126 to the pocket material 112. Alternatively, an elastic portion 127 is integrated within the pocket material 112.

Each pocket 112 is connected directly to the adjacent pocket 112, or each pocket 112 is connected to the adjacent pocket 112 by way of a connector strap 128. Connector straps 128 connects to the sides 118, front 114, or back 116 of each pocket 112, to the adjacent side 118, front 114 or back 116 of adjacent pocket 112. Connector strap 128 extends the length of pocket 112 between top 120 and bottom edge 122 or any portion thereof. In a preferred embodiment, connector strap 128 is connected to pocket 112 approximately one third of the way down pocket 112 from top 120 and extends a portion of the way down therefrom. Alternatively, a plurality of connector straps 128 are spaced along pocket 112.

Extending between opposing pockets 112 is a spacer 130. In a preferred embodiment, spacer 130 connects to the bottom edge 122 of the back 116 of each opposing pocket 112 and extends therebetween. In this embodiment, spacer 130 is connected to the bottom edge 122 of each pocket 112 by way of a seam. Alternatively, spacer 130 is seamlessly connected to the opposing pocket 112 such that both opposing pockets 112 and spacer 130 are made of a single piece of continuous material. Alternatively, spacer 130 is connected to the top 120 of each opposing pocket 112 or somewhere between the top 120 and bottom edge 122 of each pocket 112. Spacer 130 sets the maximum distance at which opposing pockets 112 can be spaced away from each other and therefore helps to form the shape of which the multiple chairs are positioned in relation to one another. Spacer 130 also fills the space between the backs 132 of chairs 34 in an aesthetically pleasing manner.

In operation a user places a back 132 of a chair 134 within each pocket 112. When doing so, the user faces the chair 134 away from the multiple-chair cover 110 and places the open bottom 122 over the top of the back 132 of the chair 134 and pulls the pocket 112 downwardly until the top of the back 132 of the chair 134 engages the top 120 of the inside of pocket 112. In this position the back 132 of the chair 134 is fully engaged in the pocket 112. The user repeats this process until each pocket 112 is fully engaged over the back 132 of a chair 134 in a fitting manner.

When the pocket 112 is pulled over the back 132 of the chair 134, the elastic strap 124 stretches thereby providing a fitting frictional force over the back 132 of the chair 134. In this way, elastic strap 124 holds pocket 112 in place over the back 132 of chair 134, and causes the pocket 112 to fit the dimensions of various chairs 134.

When each pocket 112 is fully engaged over the back 132 of a chair 134, the connector straps 128 hold each pocket 112 relative to one another. That is, connector straps 128 prevent the sides 118 of adjacent pockets 112 from separating away from each other. In addition, spacer 130 prevents the backs 116 of opposing pockets from extending too far away from each other. In this way this combination of the connector straps 128 and spacers 130 maintain the position of the plurality of pockets 112 in relation to one another when each pocket 112 is engaged over the back 132 of a chair 134. As can be seen in FIGS. 3 and 4, the plurality of pockets maintain chairs 134 in a square formation with the chairs positioned at 90 degrees from one another. In this way the multiple-chair cover 110 maintains the chairs 134 in a particular arrangement in an aesthetically pleasing manner.

Although the embodiment described above has four pockets which are arranged in a generally square shape, this is by example only. Other shapes such as a triangle or "T"-shape comprising three pockets, an "I"-shape comprising four pockets, a pentagon comprising five pockets, a hexagon or rectangle comprising six pockets, a heptagon or rectangle comprising seven pockets, an octagon, square or rectangle comprising eight pockets, or any other polygon shape made from a plurality of pockets or the like.

With reference to FIG. 5, a multiple-chair cover 10 is depicted having four pockets 112 arranged in an "I"-shape. In this arrangement, two opposing pockets are arranged in back-to-back relation. The backs 116 of these pockets 112 are directly connected to one another by way of a seam or are connected by any way known in the art. Alternatively, the backs 116 of these pockets 112 are connected by way of a back-to-back connector 136 which provides a desired amount of space between the backs 116 of opposing back-to-back pockets 112. Positioned on either side 118 of these back-to-back pockets 112 are end pockets 112. These end pockets 112 are connected to the back-to-back pockets 112 by any way described above including the use of connector straps 128 and spacer 130 and/or by direct connection of the back 116 of one pocket 112 to the side 118 of the other pockets 112. In this way the multiple-chair cover 110 maintains the backs 132 of chairs 134 in an "I"-shaped formation which is desirable in many applications.

Figure 6:
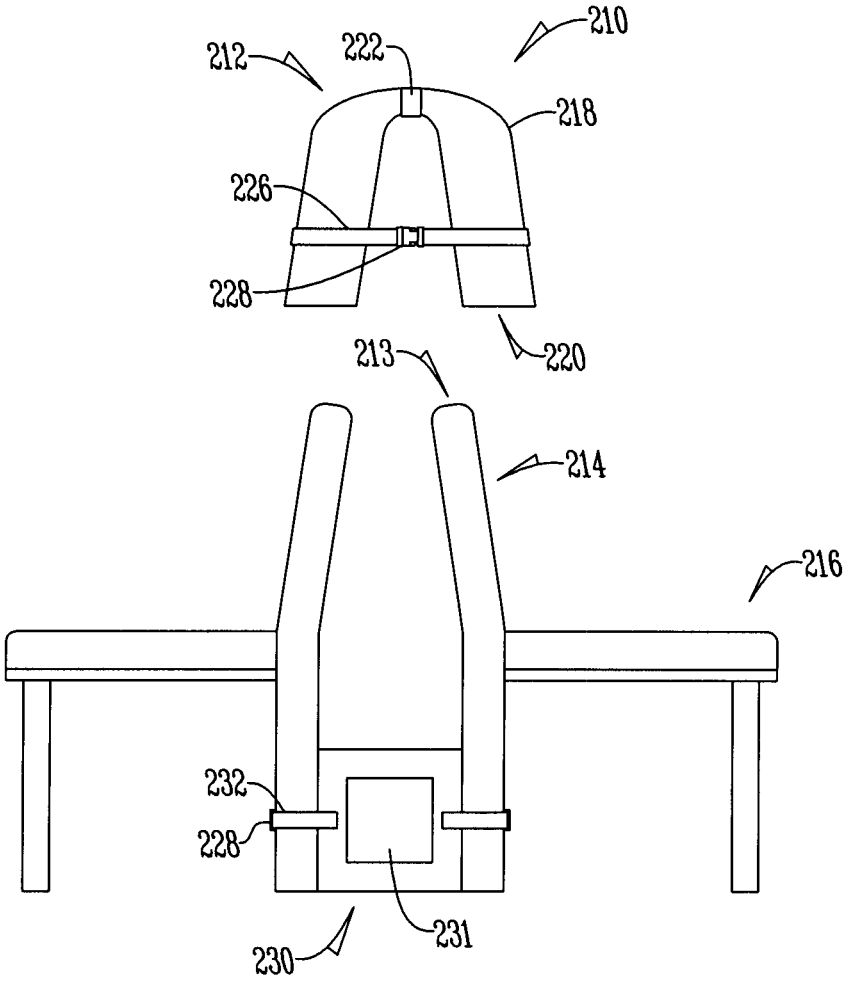
FIG. 6 is a side plan view of a third embodiment of a multiple-chair cover.

Referring to the FIG. 6, a multiple chair cover 210 has a top or first section 212 that fits over the tops 213 and/or the backs 214 of chairs 216 when the chairs 216 are arranged such that the backs 214 are adjacent. The top section 212 comprises a layer 218, preferably made of fabric that is sewn to form a pocket 220. Attached to the interior of the pocket 220 is a separator 222 that is made of a resilient material such as foam rubber or the like as described herein. The separator 222 is positioned within the pocket 220 and extends at least partially downwardly from the top of pocket 220 such that when the pocket 220 is fit over the backs 214 of chairs 216 the separator 220 fits between the top 213 of the chair backs 214. Attached to the outer surface of the pocket 220, preferably near the edge of the opening to the pocket 220, is a strap 226 that has a connecting member 228 at each end. Connecting member 228 is any member that connects two devices together such as a button and hole, a zipper, a snap-fit button, a mating male and female snap-fit clip arrangement, Velcro or the like. Straps 226 are made of any resilient material such as silicon, rubber or elastic or are otherwise non-stretchable. In addition, straps 226 have tightening means which allow for varied and adjustable lengths such as buckles, adjustable collars or the like.

In one embodiment the multiple chair cover 210 also has a bottom or second section 230 that sits on the floor between the back of the legs and seat of opposing chairs 216. Alternatively, the multiple chair cover 210 is comprised solely of the second section 230. Preferably the second section 230 is rectangular in shape and has a hollow cavity 231 so that straps 226 and the top section 212 may be stored therein. Releasably attached to the second section 230 is at least one secondary-strap 232 that is positioned to fit around the seats of opposing chairs 216 and/or around the legs of opposing chairs 216.

Secondary-straps 232 also have opposing ends with connecting members 228, as described above. Preferably, the second section 230 is covered or made of a resilient material such as foam rubber as is described herein. Preferably, second section 230 has at least one pair of opposing secondary-strap members 232 to extend around opposing chairs 216.

In operation, the chairs 216 are arranged so that their backs 214 are in alignment. The top section 212 is placed over the backs 214 of the chairs 216 such that the separator 222 is positioned between the backs 214 of the chairs 216 at or near the top 213 of the backs 214. Once in position, the strap 226 is placed around the backs 214 of chairs 216 and over top section 212. The opposing ends of strap 226 are connected to one another with connecting members 228 and the strap is tightened thereby holding the chairs 216 in a preferred arrangement. The second section 230 is placed between the back of the legs and seats of chairs 216. The secondary-straps 232 are placed around the legs and/or seats of chairs 216. The secondary-strap 232 connecting members 228 are connected and tightened thereby further holding the chairs in a preferred arrangement.

Accordingly, a chair cover has been disclosed that, at the very least, meets all of the stated objectives.

It will be appreciated by those skilled in the art that other various modifications could be made to the device without parting from the spirit and scope do this intention. All such modifications and changes fall within the scope of the claims and are intended to be covered thereby.

What is claimed:

1. A multiple-chair cover comprising:

a cover having a front side, a back side a right edge and a left edge that define an interior;

at least two dividers positioned between the right edge and left edge;

wherein the at least two dividers defines a first compartment, a second compartment and a third compartment;

at least one pad positioned within the interior;

wherein a back of a first individual chair is positioned in the first compartment;

wherein a back of a second individual chair is positioned in the second compartment; and wherein a back of a third individual chair is positioned in the third compartment wherein the multiple chair cover maintains the position of the first, second and third chairs in relation to one another.

2. The multiple-chair cover of claim 1 wherein the cover is made of a single piece of material.

3. The multiple-chair cover of claim 1 wherein the pad is positioned adjacent the at least one divider.

4. The multiple-chair cover of claim 1 wherein the pad is held in place with a pad seam.

5. A multiple-chair cover comprising:

a plurality of pockets, each having a front, a back, a top, a bottom and a pair of sides wherein each pocket is designed to receive a back of a chair;

a plurality of connector straps connecting adjacent pockets to each other; and a spacer extending between the back of a one of the plurality of pockets positioned in opposing relation to the back of another of the plurality of pockets wherein the pockets connected to the spacer are positioned in back-to-back relation to one another.

6. The multiple-chair cover of claim 5 further comprising an elastic strap connected to each pocket.

7. The multiple-chair cover of claim 5 wherein the plurality of pockets includes four pockets; wherein the four pockets are arranged in a squared alignment to one another.

8. The multiple-chair cover of claim 5 wherein a connector strap is positioned ⅓ of the way down a pocket.

9. The multiple-chair cover of claim 5 wherein the spacer connects to the bottom of the one of the plurality of pockets positioned in opposing relation to the back of another of the plurality of pockets.

10. The multiple-chair cover of claim 5 wherein the spacer connects to the top of the one of the plurality of pockets positioned in opposing relation to the back of another of the plurality of pockets.

11. The multiple-chair cover of claim 5 wherein an elastic strap is connected to a pocket.

12. The multiple-chair cover of claim 5 wherein an elastic material is integrated within a pocket.

13. A multiple-chair cover comprising:

a first section having a layer of fabric that forms a first pocket and a second pocket;

a separator positioned adjacent the first pocket and the second pocket;

a strap positioned around the first section;

wherein a back of a first chair is positioned in the first pocket; and wherein a back of a second chair is positioned in the second pocket.

14. The multiple-chair cover of claim 13 wherein the separator is a resilient material.

15. The multiple-chair cover of claim 14 wherein the first pocket and the second pocket are position such that the first chair and the second chair are positioned in opposing relation to one another.

16. The multiple-chair cover of claim 13 wherein the strap has a connecting member at each end.

17. The multiple-chair cover of claim 13 further comprising a second section;

the second section being at least partially made of a resilient material; and at least one secondary strap connected to the second section.

18. The multiple-chair cover of claim 13 wherein the separator is positioned between the first pocket and the second pocket.

* * * * *